US005333962A

United States Patent [19]

Johnson

[11] Patent Number: 5,333,962

[45] Date of Patent: * Aug. 2, 1994

[54] FOLDABLE RING BINDER-FOLDER

[75] Inventor: Noble T. Johnson, 1119 Paintbrush Trail, Cedar Park, Tex. 78613

[73] Assignees: Noble T. Johnson, Cedar Park, Tex.; Peter D. Keefe, Clinton Twp. Macomb County, Mich.

[ * ] Notice: The portion of the term of this patent subsequent to May 25, 2010 has been disclaimed.

[21] Appl. No.: 150

[22] Filed: Jan. 4, 1993

Related U.S. Application Data

[63] Continuation-in-part of Ser. No. 893,710, Jun. 5, 1992, Pat. No. 5,213,429.

[51] Int. Cl.[5] ..... B42F 3/00; B42F 13/10

[52] U.S. Cl. ..... 402/8; 402/13; 402/75; 402/79; 402/80 P; 402/80 R

[58] Field of Search ..... 402/8, 13, 75, 79, 80 R, 402/80 P

[56] References Cited

U.S. PATENT DOCUMENTS 5,167,463 12/1992 Corbishley ..... 402/8
5,213,429 5/1993 Johnson ..... 402/8

FOREIGN PATENT DOCUMENTS 646664 8/1964 Belgium ..... 402/80 R
3005878 8/1981 Fed. Rep. of Germany .... 402/60 R
407946 9/1966 Switzerland ..... 402/8
2236280 4/1991 United Kingdom ..... 402/8

*Primary Examiner*—Paul A. Bell
*Attorney, Agent, or Firm*—Peter D. Keefe

[57] ABSTRACT

A hybrid binder-folder utilizing a foldable ring system for holding pages, which affords the advantage of easy page manipulation of ring binders with the advantage of flat folding of folders. The binder-folder has two side members which are mutually foldable along the centerline therebetween. Two, three or more foldable rings of flat, thin cross-section and of substantially semicircular shape are connected with the side members adjacent with and transverse to the centerline. When the two side members are mutually folded closed, the foldable rings fold along three folds: adjacent each connection with the two side members and at the ring apex. As a result of this foldability feature, the foldable rings are able to flatly fold, thereby permitting the binder-folder to be substantially flat when closed. When the side members are folded open, the rings unfold along the three folds to become substantially semicircularly shaped rings for guiding pages trapped on the foldable rings in the manner of a conventional ring binder. Removal and insertion of pages with respect to the foldable rings is achieved by a ring connection mechanism which is releasable with respect to one or both of the side members of the binder-folder, or else the foldable rings may be structured to be selectively openable. A kit is provided for converting a folder into a binder-folder.

23 Claims, 6 Drawing Sheets

FOLDABLE RING BINDER-FOLDER

CROSS-REFERENCE TO RELATED APPLICATIONS

The present Application is a Continuation-in-Part of co-pending application Ser. No. 07/893,710, filed on Jun. 5, 1992, now U.S. Pat. No. 5,213,429, issued on May 25, 1993.

BACKGROUND OF THE INVENTION

1. Field of the Invention

The present invention relates to page connection systems used in binders and folders. More particularly, the present invention relates to a foldable ring system of a hybrid binder-folder which permits easy page removal and insertion, arcing page movement, and thin folding of the binder-folder.

2. Description of the Prior Art

Conventional ring binders utilize two, three or more rings connected with the spine of the ring binder for holding pages, usually in the form of sheets paper. The side members of the ring binder are foldably connected with the spine, and the rings are structured to selectively open and close in order to permit page insertion and removal with respect thereto. In operation, a user would open the ring binder with the side members of the ring binder on a resting surface and the rings facing up toward the user. The rings are then opened, pages having holes punched therein are then added or subtracted from the rings and the rings are then closed. Thereafter, the pages are arcably moved on the the rings in order for the user to locate a selected page. When it is time to close the ring binder, the side members are folded so that the distal ends of the side members remote from the spine come into, or nearly into, adjacency. The resulting shape is far from being flat, in that the spine must be of at least a minimal width sufficient to accommodate the diameter of the rings. Consequently, the shape of a closed ring binder is generally triangular. Thus, a ring binder is of considerable thickness when closed even if no pages are held on the rings. As a result, it would be advantageous to provide a page holder which does not suffer from having an unavoidably wide spine.

An alternative to ring binders are folders. Folders have two or more page engagement members in the form of a pair of metallic flaps which insert through a hole in the page and then are folded over flat with respect to the fold centerline of the folder. In this regard, the side members of the folder fold along the centerline and the resulting shape is substantially flat. Another advantage of folders is that the side members can be folded back on themselves, thereby making it easier to handle the folder and resulting in a minimized footprint on a desk top. While folders eliminate the spine problem of ring binders, they suffer from the pages not being as readily manipulated in the manner possible only with rings.

Therefore, what is needed in the art is a system for holding pages having the advantages of both a ring binder and a folder without the disadvantages of either.

SUMMARY OF THE INVENTION

The present invention is a hybrid binder-folder utilizing a foldable ring system for holding pages, which affords the advantage of easy page manipulation of ring binders with the advantage of flat folding of folders.

The binder-folder according to the present invention has two side members which are mutually foldable along the centerline therebetween. Two, three or more foldable rings of flat, thin cross-section and of substantially semicircular shape are connected with the side members adjacent with and transverse to the centerline. When the two side members are mutually folded closed, the foldable rings fold along three folds: adjacent each connection with the two side members and at the ring apex. As a result of this foldability feature, the foldable rings are able to flatly fold, thereby permitting the binder-folder to be substantially flat when closed. When the side members are folded open, the rings unfold along the three folds to become substantially semicircularly shaped rings for guiding pages trapped on the foldable rings in the manner of a conventional ring binder.

Removal and insertion of pages with respect to the foldable rings is achieved by a ring connection mechanism which is releasable with respect to one or both of the side members of the binder-folder, or else the foldable rings may be structured to be selectively open able.

Further, a conventional folder may be converted into a binder-folder according to the present invention by the installation therein of a foldable ring kit.

Accordingly, it is an object of the present invention to provide a binder-folder which functions similar to a ring binder, but without a spine.

It is a further object of the present invention to provide a binder-folder which functions similar to a folder, but has rings.

It is an additional object of the present invention to provide a binder-folder having a plurality of foldable rings which are foldable so as to permit the binder-folder to be closed substantially flat.

It is another object of the present invention to provide a binder-folder that holds pages in a manner substantially similar to that of a ring binder, yet is flatly foldable in a manner substantially similar to a folder.

It is yet another object of the present invention to provide a binder-folder which permits pages to be manipulated on foldable rings when the binder-folder is open, yet is substantially flat when the kinder-folder is folded closed, in which the foldable rings are selectively releasably connected with the binder-folder for permitting removal and insertion of pages with respect thereto.

It is still an additional object of the present invention to provide a binder-folder which permits pages to be manipulated on foldable rings when the binder-folder is open, yet is substantially flat when the binder-folder is folded closed, in which the foldable rings are selectively openable for permitting removal and insertion of pages with respect thereto.

It is yet an additional object of the present invention to provide a kit for converting a conventional folder into a binder-folder which functions similar to a ring binder, but without a spine.

These, and additional objects, advantages, features and benefits of the present invention will become apparent from the following specification.

DETAILED DESCRIPTION OF THE PREFERRED EMBODIMENT

Figure 1:
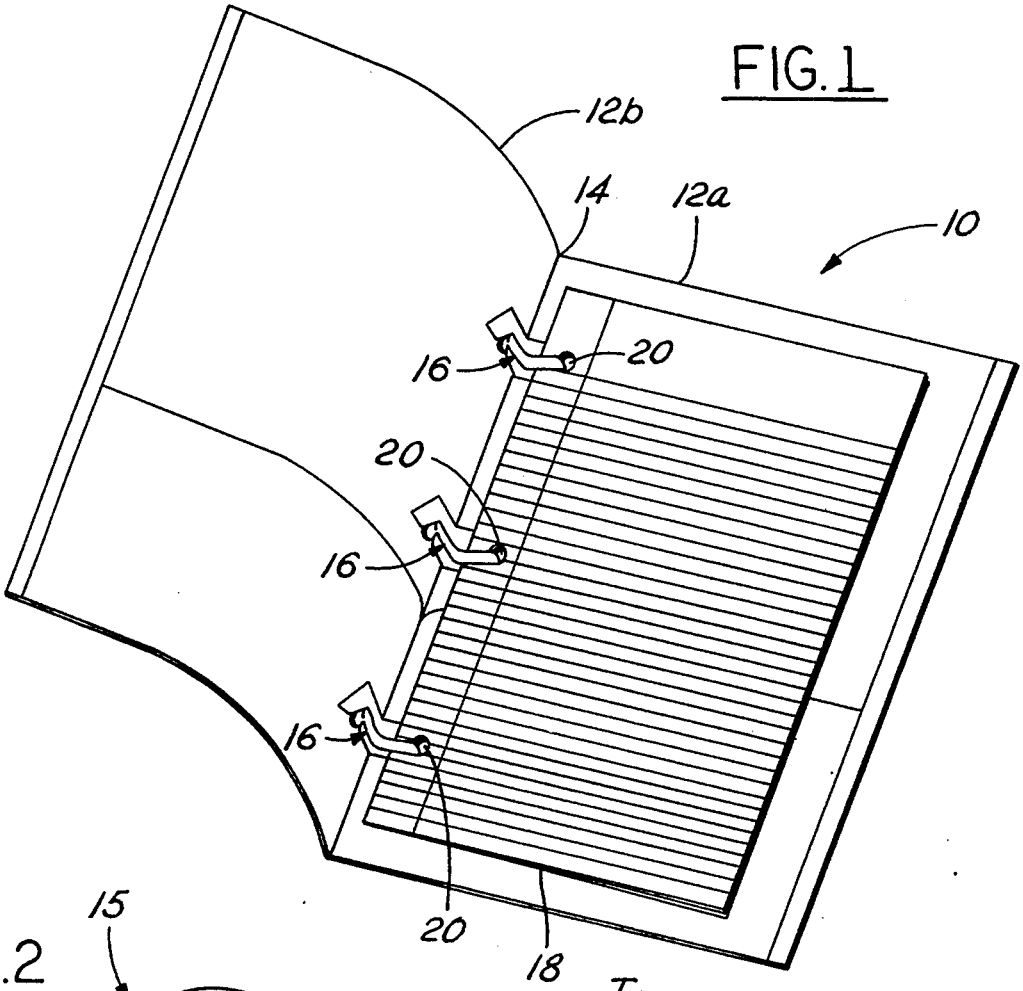
FIG. 1 is a perspective view of a binder-folder according to the present invention, shown in a substantially open orientation in operation with respect to a plurality of pages.

Referring now to the Drawing, FIG. 1 shows generally the binder-folder 10 according to the present invention. The binder-folder is composed of two side members 12*a*, 12*b* which are mutually foldably connected together along a centerline fold 14. The binder-folder 10 is further composed of a plurality of foldable rings 16 connected with the side members 12*a*, 12*b* for interconnecting with pages 18 via the respective holes 20 thereof. Because the foldable rings 16 are not rigid, they may fold from a semi-circular shape into a collapsed flat shape. Accordingly, there is no need for a spine. As a result of this structure, the binder-folder 10 has a ring binder-like page manipulation advantage, as well as a folder-like centerline folding advantage which permits it to be of a generally flat shape when closed and further permits it to be folded back on itself, thereby making it easier to handle and to have a minimized footprint on a desk top.

The side members 12*a*, 12*b* are constructed of rind, semi-rigid or flexible materials commonly used in conventional ring binders and folders. The dimension of the side members 12*a*, 12*b* is predetermined to protectively cover the pages 18 in the manner of a ring binder or folder. The centerline fold 14 is positioned medially with respect to the two side members 12*a*, 12*b*, and it is preferred, but not required, that the two side members be mutually integral Alternatively, for instance, the two side members 12*a*, 12*b* could be hingably interconnected, in which case the centerline fold 14 operates by means of a hinge, such as a piano hinge.

Figure 2:
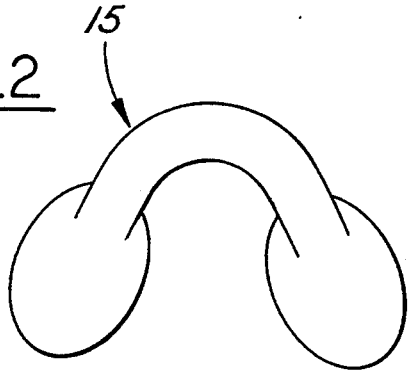
FIG. 2 is a top plan view of a foldable ring according to the present invention die cut from a plastic sheet stock.

FIG. 2 depicts a preferred method of forming the foldable rings 16 via die cutting of a plastic sheet stock material into a piece 15, as shown. The die cut piece 15 is then provided with folds memorized by the material to form the foldable ring 16 shown in FIG. 3.

Figure 3:
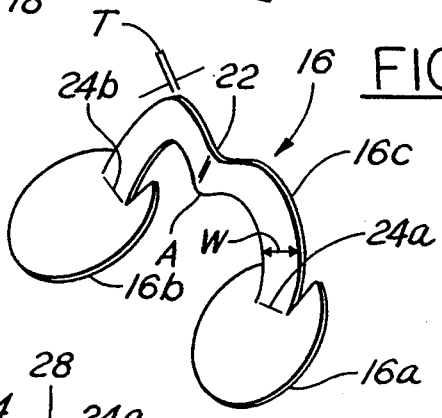
FIG. 3 is a detail perspective view of a foldable ring according to the present invention.

It is seen in FIG. 3 that the foldable ring 16 includes a ring portion 16*c* and an integrally connected foot portion 16*a*, 16*b* at either end of the ring portion. The ring portion 16*c* is of a generally semi-circular shape when unfolded, having an apex A. The ring portion 16*c* preferably has an apex fold 22 which is memorized by the material of which the foldable ring 16 is constructed. The material is preferred to be a durable, flexible, substantially nonstretchable plastic, although other materials may be used. As can be discerned from FIGS. 1 and 3, the foldable rings 16 are dimensioned so as to have a ring diameter similar to that of the rings used in conventional ring binders, as for example on the order of one-half to two inches. The foldable rings 16 are thinly constructed. That is, the thickness T thereof is preferred to be at least an order of magnitude less than the width W, although this is not a requirement. In this regard, the thickness T should be thin and uniformly flat so that the foldable ring 16 can flatly fold so as to occupy very little cross-sectional space, and the width W is selected to be less than the hole diameter of the pages so that the pages can travel on the ring portions 16*c* in the manner customary with conventional ring binders. For example, the foldable rings 16 may have a substantially flat thickness T on the order of about five-thousandths inch, and a ring width W just under about one-quarter inch, which is a little less than the hole diameter made by a paper punch. It is further preferred for the ring portion 16c of each of the foldable rings 16 to include basal folds 24a, 24b memorized by the material adjacent respective foot portions 16a, 16b. The basal folds 24a, 24b and apex fold 22 combine to provide a predictable and efficient folding of the foldable rings 16 when the binder-folder 10 is closed by a user, without interference with respect to the pages 18.

It is preferred for the basal folds 24a, 24b to be oriented at an angle other than perpendicular with respect to the centerline fold 14 in order for the basal folds to provide urging of the ring portion 16c to assume an upstanding open orientation as the two side members 12a, 12b are mutually opened. In this regard, each basal fold angle B is preferred to be between 75 and 60 degrees with respect to the centerline fold 14, wherein the two basal angles have an imaginary intersection in the direction of fold of the apex fold 22 (see FIG. 4).

Figure 4:
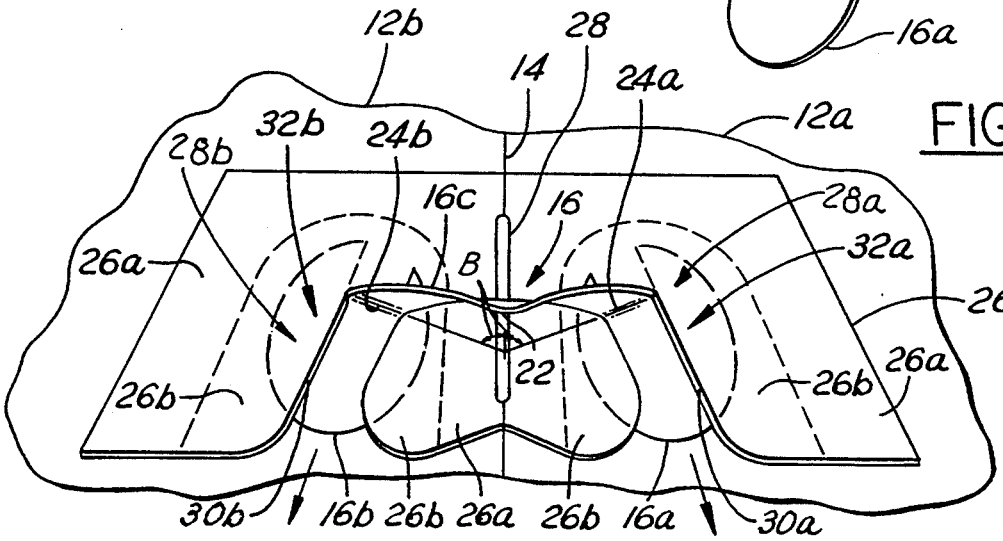
FIG. 4 is a detail perspective view of a first preferred attachment mechanism for connecting the foldable rings to the side members of the binder-f older.

As can be discerned from FIG. 4, each of the foldable rings 16 is connected with the side members 12a, 12b so that the ring portion 16c is oriented transverse with respect to the centerline fold 14. In this regard, one foot portion 16a, 16b is connected with a respective one of the side members 12a, 12b at the aforesaid angle B. In the foldable ring embodiment shown in FIG. 4, the ring portion 16c is a single piece unit. Thus, in order to add or remove pages 18 with respect to the binder-folder 10, one or both foot portions 16a, 16b must be selectively releasable with respect to its respective side member. This is accomplished by way of preferred example through the use of a base member 26. The base member 26 straddles the centerline fold 14 and is connected to each of the side members 12a, 12b by any conventional means, such as by adhesive G as shown in the Drawing (for paper product construction) or by sonic welding (for plastic product construction). A selected portion 26a of the base member 26 is connected to the side members 12a, 12b. The remainder 26b thereof that is not connected to the side members forms two pockets 28a, 28b. Each pocket 28a, 28b has a slot 30a, 30b which is approximately dimensioned to coincide with the foldable ring width W. The combination of each pocket with its respective slot forms pocket-slots 32a, 32b, each structured so that the ring portion 16c and respective foot portion 16a, 16b may slide thereinto, while the respective foot portion is interferingly trapped in the normal direction with respect thereto, as shown in FIG. 4. Since the foot portions 16a, 16b are slidable with respect to the respective pocket-slots 32a, 32b, they my be selectively removed therefrom (along the arrows in FIG. 3) and inserted thereinto (in the reverse direction) so as to permit a user to add or remove pages 18 from each foldable ring 16. In this regard, the foot portions 16a, 16b are flexible so as to be flexed and thereby inserted through the holes 20. The base member 26 may or may not include a medial cut-out 28 along the centerline fold 14 for facilitating foldability of the side members 12a, 12b along the centerline fold.

Figure 5:
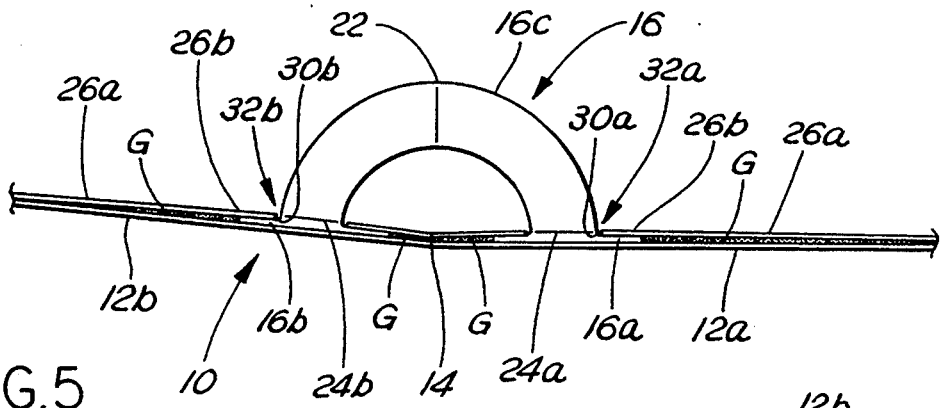
FIG. 5 is an end view of the binder-folder according to the present invention, shown in an open orientation with the foldable ring unfolded in to a semi-circular ring.
Figure 6:
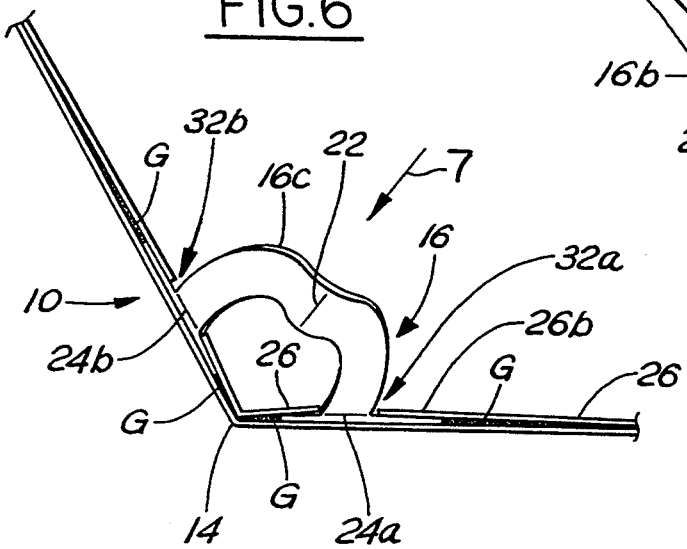
FIG. 6 is an end view of the binder-folder according to the present invention, shown in a first partly open orientation with the foldable ring partly folded.
Figure 7:
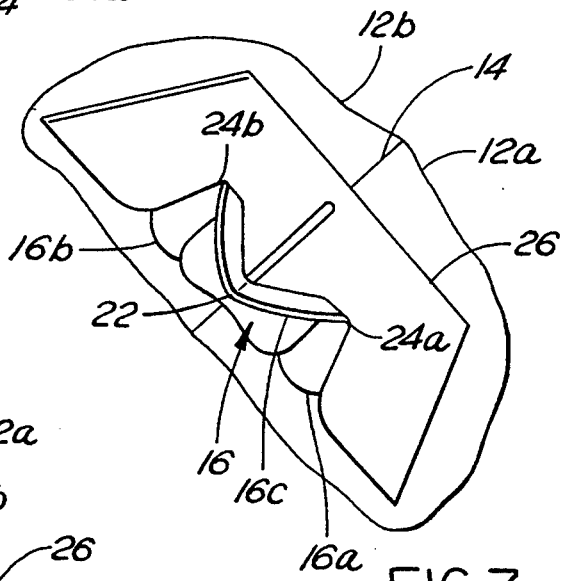
FIG. 7 is a perspective detail view seen along arrow 7 in FIG. 6.
Figure 8:
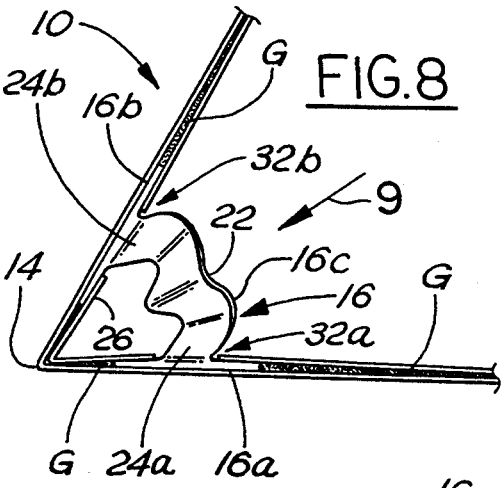
FIG. 8 is an end view of the binder-folder according to the present invention, shown in a second partly open orientation with the foldable ring folded more than that depicted in FIG. 5.
Figure 9:
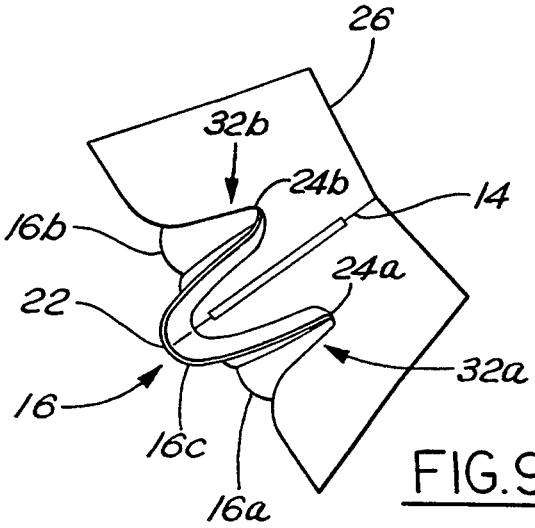
FIG. 9 is a perspective detail view seen along arrow 9 in FIG. 8.
Figure 10:
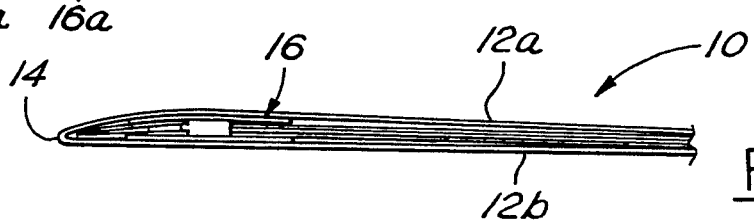
FIG. 10 is an end view of the binder-folder according to the present invention, shown in a closed orientation with the foldable ring flatly folded.

FIGS. 5 through 10 depict operation of the binder-folder 10, from an open orientation, shown in FIG. 5, to a closed orientation shown in FIG. 10, and vice versa.

As can be understood from FIG. 5, in the open orientation, the ring portion 16c of the foldable rings 16 are in the unfolded configuration so that pages can be arcably manipulated on them in the manner used with respect to conventional ring binders. Now, when it is desired to close the binder-folder 10, the binder-folder is folded along the centerline fold 14 and the foldable rings 16 fold along the apex fold 22 and the two basal folds 24a, 24b as progressively depicted in FIGS. 5 through 10, until the binder-folder is in the closed orientation, whereat the foldable rings are in the folded configuration. As can be seen in FIG. 10, the foldable rings 16 fold flatly so that the cross-section of the binder-folder is very small, similar to that of a conventional folder.

While folding along the apex fold 22 and the two basal folds 24a, 24b is preferred, this is not a requirement, as any sort of folding which accomplishes substantially flatly folded foldable rings similar to that shown in FIG. 10 is acceptable. Indeed, when pages 18 are present, the foldable rings 16 may not necessarily fold at the basal folds, but rather fold at an intermediate location between the basal folds and the apex fold due to the holes of the pages regulating how the foldable rings fold. However, it is preferred that the material of each foldable ring 16 have a memorized apex fold 22 and memorized basal folds 24a, 24b so that folding is predictable and efficient, with as little interference with respect to the pages as possible. In this regard, it is preferred that all foldable rings fold in the same orientation, with the basal folds folding acutely with respect to the foot portions 16a, 16b (as shown).

Figure 11:
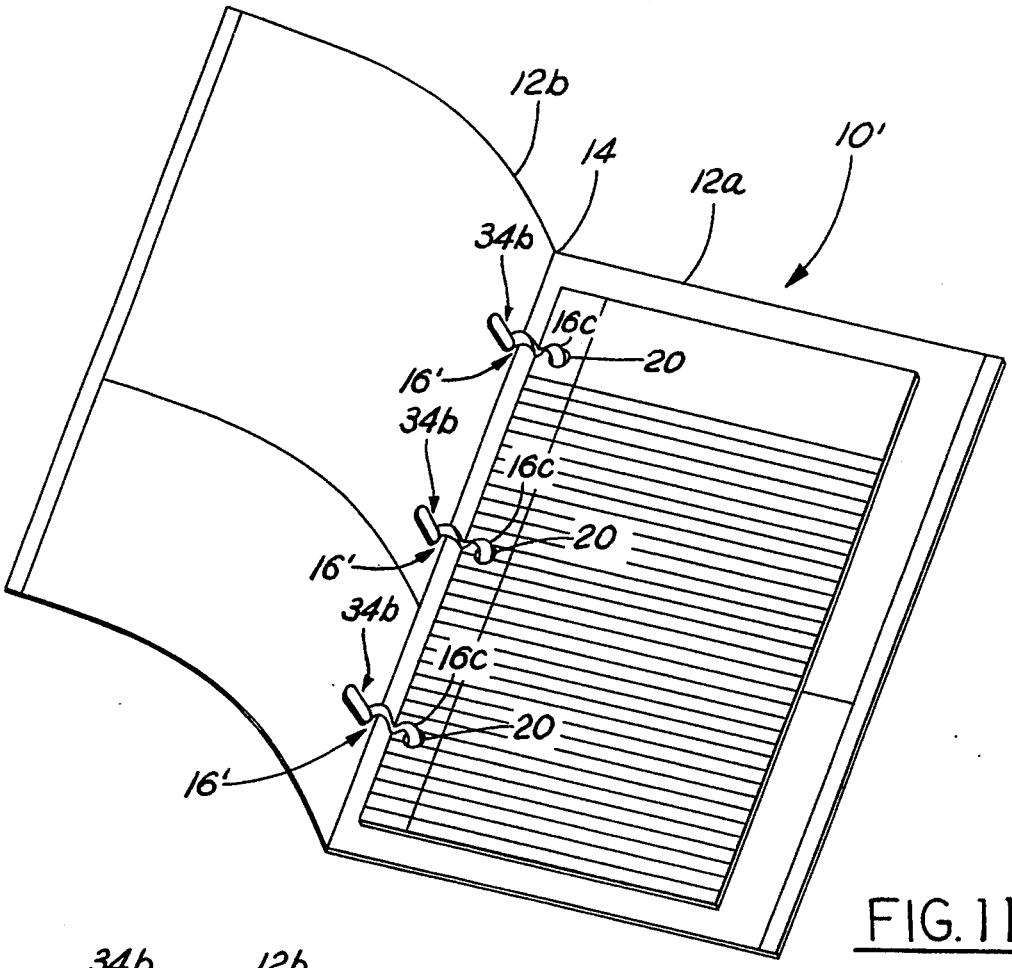
FIG. 11 is a perspective view of a binder-folder according to the present invention, shown in a substantially open orientation in operation with respect to a plurality of pages, a second foldable ring attachment mechanism being depicted.
Figure 12:
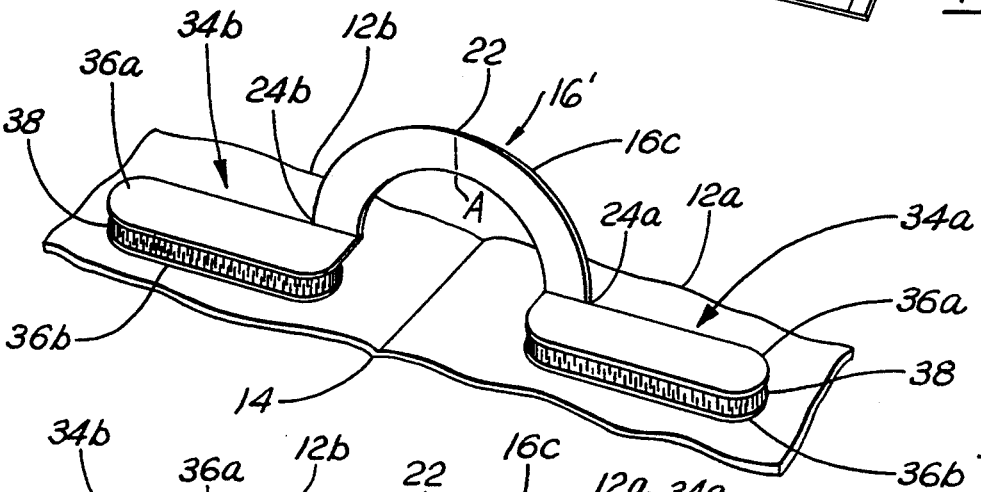
FIG. 12 is a detail perspective view of the second foldable ring attachment mechanism releasably connecting a foldable ring to the side members of the binder-folder, the binder-folder being in an open configuration.
Figure 13:
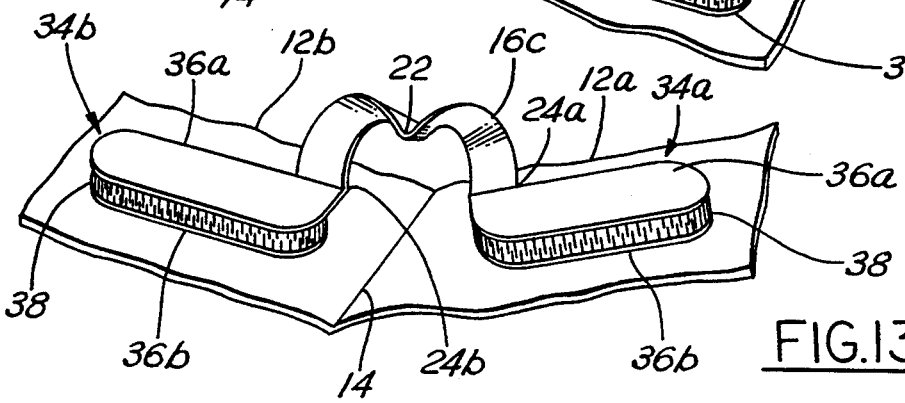
FIG. 13 is a detail perspective view of the second foldable ring attachment mechanism releasably connecting a foldable ring to the side members of the binder-folder, the binder-folder being in a partly open configuration.

Turning now to FIGS. 11 through 13, an alternative binder-folder 10' is depicted, wherein a foldable ring 16' having modified foot portions is employed. In this modification, the foldable rings 16' have the same ring portion structure 16c as in the previously discussed foldable rings 16; however, now included are modified foot portions 34a, 34b connected with either end of the ring portion 16c. The modified foot portions 34a, 34b are bifurcated into an upper half 36a and a lower half 36b. Each lower half 36b is connected with a respective side member 12a, 12b in the manner discussed hereinabove with respect to the foot portions 16a, 16b. A two component releasable fastener 38 connects the upper and lower halves. In this regard, one component of the two component fastener is connected respectively with each upper half 36a and a second component of the two component fastener is connected respectively with each lower half 36b. A preferred releasable fastener 38 is a hook and loop fastener of the type manufactured under the trademark VELCRO.

In operation, to add or remove pages from the foldable rings 16', the user need only separate the upper and lower halves of one of the foot portions 34a or 34b so as to let the holes of the page slip through the chosen foot portion, either with respect to adding or removing pages to the foldable rings.

It is to be understood that while two preferred examples of releasable attachment of foldable rings to the side members is shown herein, there are many other equivalent structures that can be used for this purpose, and these are contemplated within the scope of the present invention.

FIGS. 14 and 15 and 21 through 23 depict openable foldable ring structures in which pages may be entered upon and removed from the foldable rings by opening them and thereafter closing them.

Figure 15:
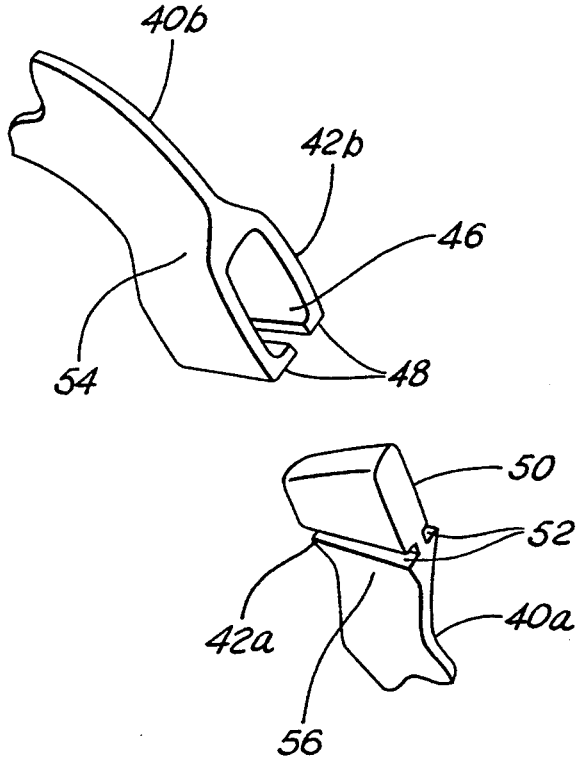
FIG. 15 is a detail perspective view of the selectively releasable ring interconnection mechanism.
Figure 14:
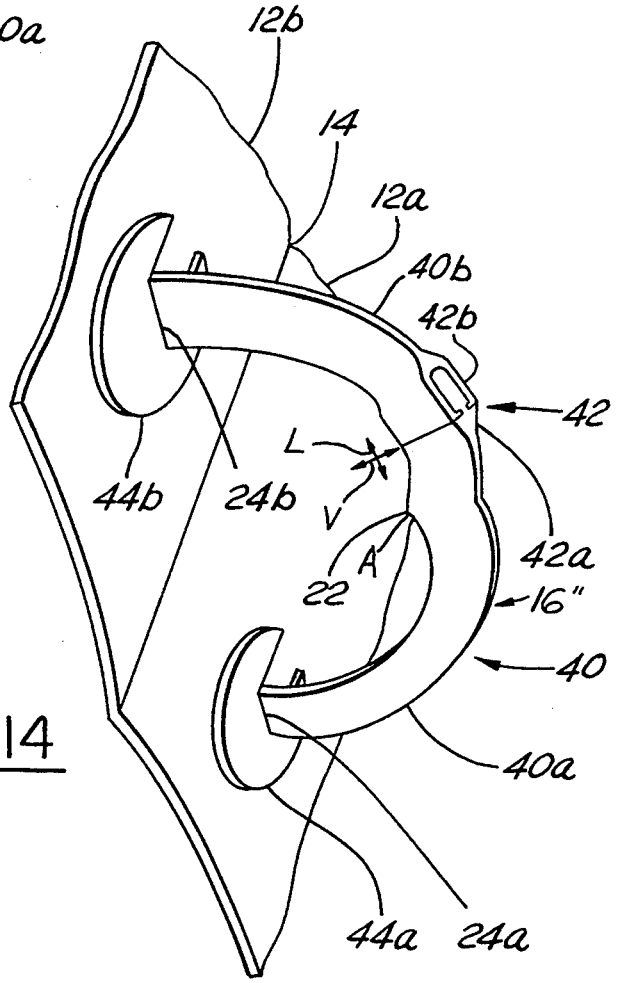
FIG. 14 is a perspective view of an embodiment of an openable foldable ring having two ring sections mutually selectively releasably connected adjacent the ring apex.

FIGS. 14 and 15 disclose openable foldable rings 16'' constructed of a two section ring portion 40 having a connector 42. A first ring section 40a terminates in a male connector 42a, and the second ring section 40b terminates in a female connector 42b. The male connector 42a includes a male portion 50 connected integrally with the first ring section 42a whereat is located a pair of slots 52 on either side thereof, each slot being oriented in the transverse axis V. The female connector 42b includes a female portion 46 integrally connected with the second ring section 40b and is terminally defined by a pair of transversely oriented bosses 48. The bosses 48 are structured to slide into the slots 52 when the male portion 50 is slid transversely into the female portion 46. As will be understood from FIG. 14, when this transverse sliding movement is performed, the bosses interferingly engage with the slots so as to prevent the two ring sections 40a, 40b from mutually separating along the longitudinal axis L, wherein the longitudinal axis is parallel with respect to a tangent to the ring portion at the connector 42. It is preferred that a regulating structure control the placement of the male connector with respect to the female connector so that the ring portion everywhere presents a smooth surface with respect to the holes of the pages. An example of such a structure is shown in FIG. 15, wherein complementary wedge shaping is used to regulate transverse travel of the male connector 42a relative to the female connector 42b in order to provide properly aligned seating therebetween.

The foot portions 44a, 44b are integrally connected with respective ring sections 40a, 40b, and the foot portions connect with respective side members 12a, 12b. Basal folds 24a, 24b, oriented at the aforesaid preferred angle B, are preferably provided as discussed hereinabove with respect to the other embodiments of the foldable rings 16, 16'. An apex fold 22 is provided at the apex A of the two section ring portion 40, and the connector 42 is offset on one side or the other with respect to the apex fold so as not to interfere with its foldability, the left side (as shown) being preferred.

A first tapered portion 54 adjacent the female connector 42b and a second tapered portion 56 adjacent the male connector 42a provide a smooth transition between the thickness of the connector 42 (which is preferably much less than the diameter of the holes 20) and the thickness of the first and second ring sections 42a, 42b (which is the same as thickness T in FIG. 3).

In operation, when a user desires to add or delete pages from the openable foldable rings 16'', the male connector 42a is transversely moved with respect to the female connector 42b so that the first and second ring sections 40a, 40b are separated from each other. After page adjustment has been made, the male connector is moved transversely with respect to the female connector so that the male portion 50 is again seated into the female portion 46. Pages may now be manipulated on the openable foldable rings 16'' in the manner used with respect to conventional ring binders, and the binder-folder may be closed and the openable foldable rings will thereupon fold flatly in the manner discussed hereinabove.

Figure 21:
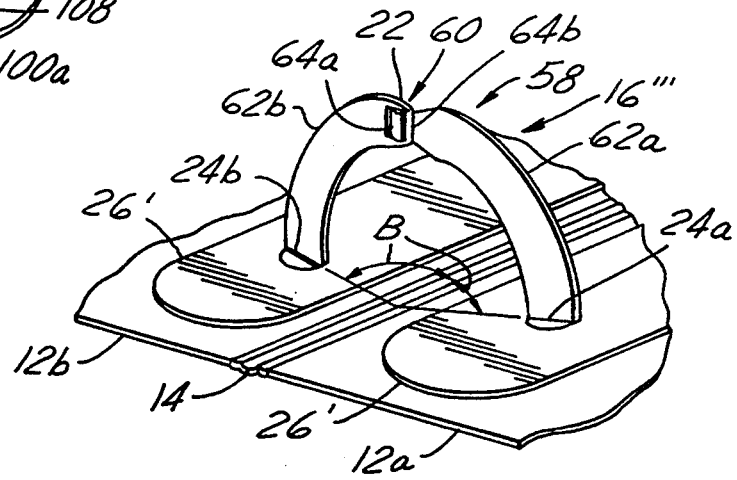
FIG. 21 is a detail perspective view of an openable foldable ring having a hinged connector for selectively connecting two ring sections, shown in a dosed configuration.
Figure 22:
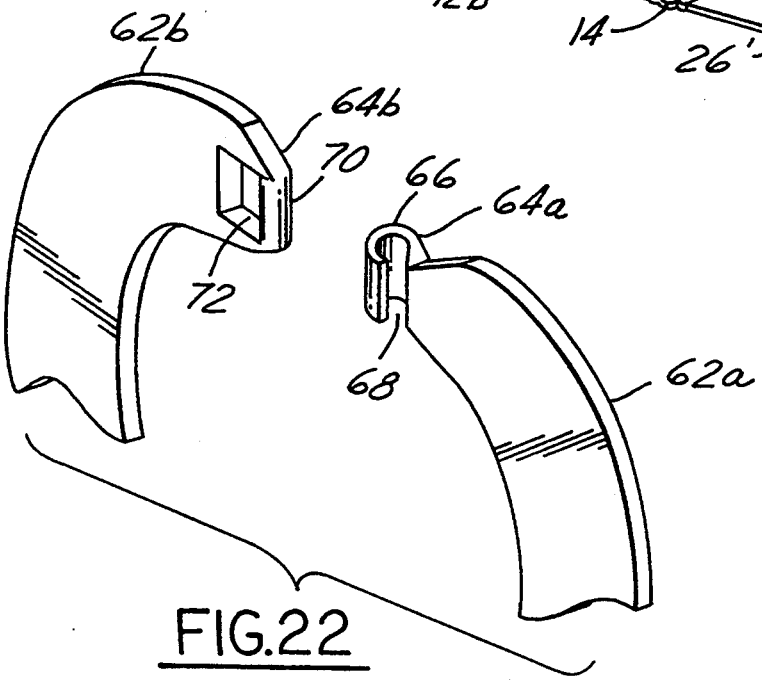
FIG. 22 is a detail perspective view of the openable foldable ring as depicted in FIG. 21, now shown in an open configuration.
Figure 23:
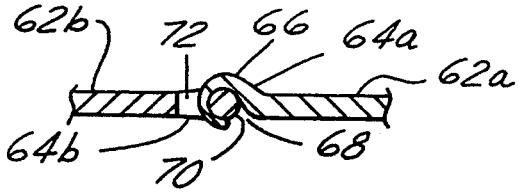
FIG. 23 is a detail sectional plan view of the openable foldable ring as shown in FIG. 21.

FIGS. 21 through 23 depict openable foldable rings 16''' constructed of a two section ring portion 58 having a hinged connector 60 located at the apex fold 22. A first ring section 62a terminates in a male connector 64a, and the second ring section 62b terminates in a female connector 64b. The male connector 64a includes a clasp 66 connected integrally with the first ring section 62a. A slot 68 is provided in the clasp 66. The female connector 64b includes a post 70 and an adjoining notch 72 that are integrally formed with the second ring section 62b, although the post may be alternatively constructed of metal of some material other than that of the second ring portion 62b and held fast thereto by any conventional fastener means. As will be understood from FIGS. 22 and 23, the clasp 66 is structured to snappingly engage with the post 70, the slot 68 being dimensioned to be spreadably opened upon engagement and disengagement of the clasp with the post so as to provide a snapping engagement between the clasp and the post. In the preferred example shown in FIG. 21, each of the first and second ring sections 62a, 62b is provided with a foot portion (not shown) which is held with respect to the side members 12a, 12b by a base member 26'. As further indicated in FIG. 21, the basal folds 24a, 24b are preferably at the aforementioned angle B with respect to the centerline fold 14.

In operation, the user opens the openable foldable rings 16''' by manipulating the clasp so that the post slides past the slot. Pages may now be placed onto or removed from either of the first and second ring sections. The openable foldable ring 16''' is again formed by the clasp being again placed on the post by the post being forced past the slot. The apex fold 22 is provided by the clasp rotatively moving with respect to the post as the side members are mutually foldably moved with respect to the centerline fold 14. Preferably the slot 68 is located with respect to the post 70 such that as the openable foldable ring 16''' folds, the slot faces forwardly in the direction of fold; this placement enhances assurance of the post staying within the clasp during folding.

Turning attention now to FIGS. 16 through 20 an alternative foldable ring system will be described which allows for kit installation with respect to a conventional folder.

Figure 16:
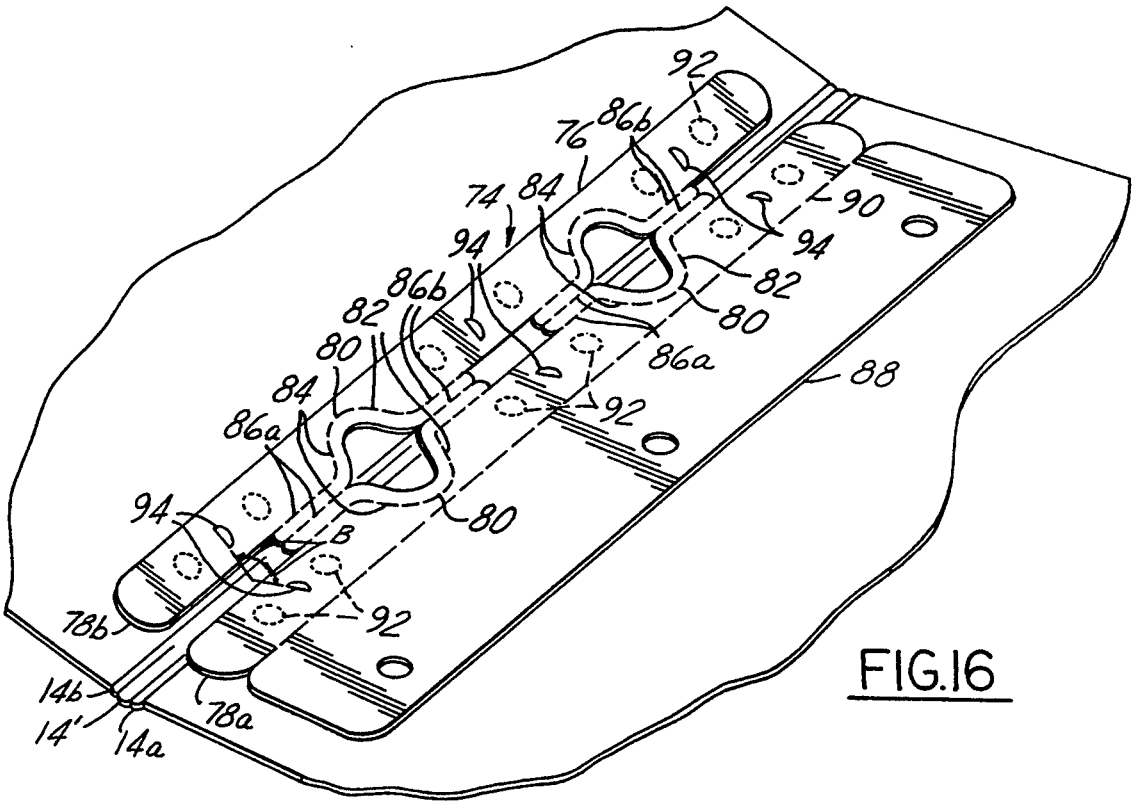
FIG. 16 is a perspective view of a folder having attached thereto a first type of foldable ring kit for converting the folder in to a binder-folder.
Figure 17:
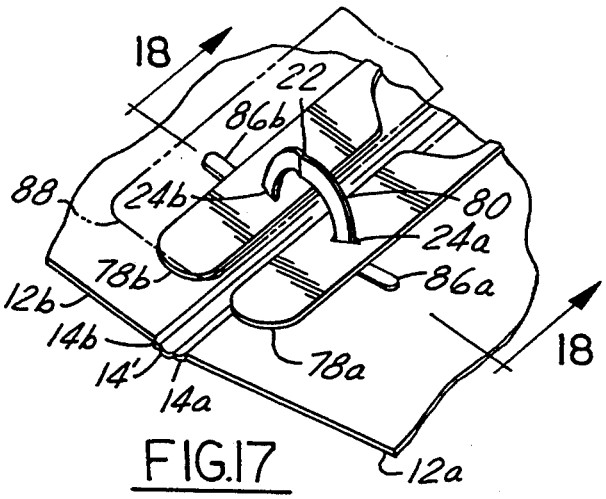
FIG. 17 is a partly broken away perspective view of the binder-folder provided by completion of installation steps of the first type of foldable ring kit depicted in FIG. 16.
Figure 18:
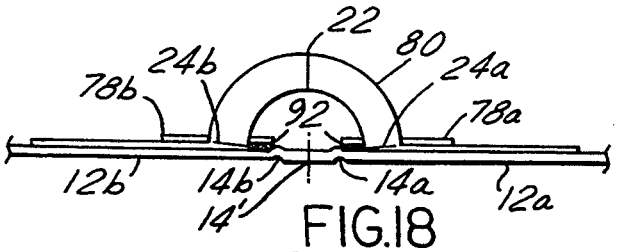
FIG. 18 is a partly broken away end view of the binder-folder, seen along lines 18—18 in FIG. 17.

Firs fly with regard to FIGS. 16 through 18, a first type of foldable ring kit 74 is depicted. In this regard, a blank 76, preferably constructed of a durable and non-stretchable plastic sheet of the aforesaid thickness T, has been die cut to provide all the features necessary to convert a conventional folder into a binder-folder 10. The blank 76 has a pair of base members 78a, 78b which are mutually separated a small predetermined distance, but are mutually connected together at several locations by a one or more of sets of foldable rings 80. Each foldable ring 80 is defined by perforations 82 in respective base members 78a, 78b, which permit removal therefrom by a user simply lifting them tearably along the perforations. Each foldable ring 80 is provided with a ring portion 84 and foot portions 86a, 86b. A binder lifter 88 is optionally provided with the blank 76 via perforations 90. The blank 76 may be provided in kit form for a user to attach to a folder, or may be preattached to a folder (as it is shown in FIG. 16). Attachment of the base members 78a, 78b to the two side members 12a, 12b is provided by an adhesive positioned preferably at selected locations 92. The adhesive is preferably of the peelable cover kind. It is also seen that the base centerline between the first and second base members 78a, 78b coincides with the centerline 14' between the first and second side members 12a, 12b. Slots 94 are provided in each of the base members 78a, 78b, having the aforesaid angle B with respect to the centerline 14'. The slots provide an entry point for sloping the foot portions 86a, 86b securably between the base members 78a, 78b and the side members 12a, 12b, as shown in FIG. 17. In this regard, the aforementioned adhesive locations may be anywhere except where the foot portions 86a, 86b insert between the base members 78a, 78b and the side members 12a, 12b. The basal folds 24a, 24b are oriented at the aforementioned angle B are provided by the user folding over the foldable rings 80 thereat, while the apex fold 22 is provided by the user pinching the foldable rings 80 thereat.

Notice that FIGS. 17 through 18 depict folding of the two side members 12a, 12b along two folds 14a, 14b. In such a case, the centerline 14' lies equidistant therebetween and serves as the equivalent of the centerline fold 14 in that folding of the side members is in effect performed relative this line. While the space between the two folds 14a, 14b is in effect a spine and it is clear that the foldable rings according to the present invention work perfectly well therewith, a binder-folder having a single fold at the centerline, i.e., the centerline old 14, is preferred, albeit not required.

Figure 19:
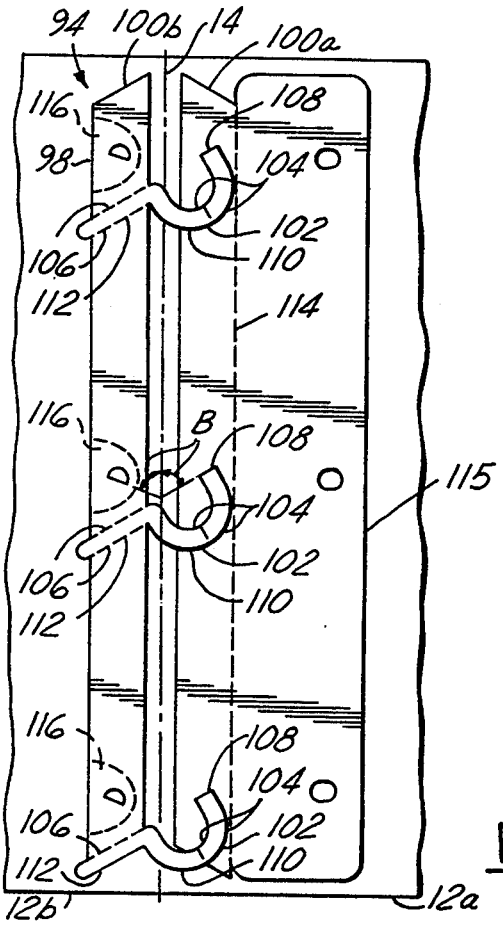
FIG. 19 is a perspective view of a folder having attached thereto a second type of foldable ring kit for converting the folder into a binder-folder.
Figure 20:
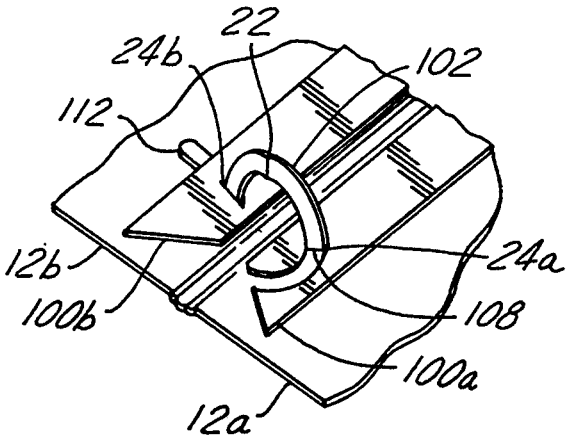
FIG. 20 is a partly broken away perspective view of the binder-folder provided by completion of installation steps of the second type of foldable ring kit depicted in FIG. 19.

Now, secondly with regard to FIGS. 19 and 20, a second type of foldable ring kit 96 is depicted. In this regard, a blank 98, again, preferably constructed of a durable and non-stretchable plastic sheet of thickness T, has been die cut to provide all the features necessary to convert a conventional folder into a binder-folder 10. The blank 98 has a pair of base members 100a, 100b which are mutually separated a small predetermined distance, but mutually connected together at several locations by a number of foldable rings 102. Each foldable ring 102 is defined by die cuts 104 and perforations 106 in respective base members 100a, 100b, which permit partial removal therefrom by a user simply lifting them tearably along the perforations. The foldable rings 102 remain connected with one of the base members 100a at a foot attachment 108. Each foldable ring 102 is provided with a ring portion 110 and a foot portion 112. A binder lifter 115 is optionally provided with the blank 98 via perforations 114. The blank 98 may be provided in kit form for a user to attach to a folder, or may be preattached to a folder (as it is shown in FIG. 19). Attachment of the base members 100a, 100b to the two side members 12a, 12b is provided by an adhesive located preferably everywhere except at selected locations 116. The adhesive is preferably of the peelable cover kind. The base centerline between the first and second base members 100a, 100b coincides with the centerline fold 14. Slots 118 are provided in the other of the base members 100b; both the slots 118 and the foot attachments 108 are at the aforementioned angle B with respect to the centerline fold 14. The slots 118 provide an entry point for sloping the foot portion 112 securably between the base member 100b and the side member 12b where the adhesive is absent, as shown in FIG. 20. The basal folds 24a, 24b are oriented at the aforementioned angle B and are provided by the user folding over the foldable rings 102 thereat, while the apex fold 22 is provided by the user pinching the foldable rings 102 thereat.

To those skilled in the art to which this invention appertains, the above described preferred embodiment may be subject to change or modification. For instance, while pages in the form of sheets of paper are a preferred hole punched item to be used in connection with the binder-folder 10, more-or-less anything having hole punching can be used. Also, while the preferred structure of the present invention is a binder-folder as described hereinabove, the foldable rings can be used in connection with any kind of holder for pages. Further, while foldable rings constructed of a flexible sheet plastic are preferred, it is possible to construct the foldable rings from rigid or semi-rigid material which is hinged (as for example by a living hinge or a pivotable hinge) at various selected locations, particularly at the apex fold and the two basal folds. Such change or modification can be carried out without departing from the scope of the invention, which is intended to be limited only by the scope of the appended claims.

What is claimed is:

1. A binder-folder for holding pages, the pages having at least one hole, said binder-folder comprising:

a first side member; a second side member foldably connected to said first side member, a centerline being located therebetween;

at least one foldable ring, each foldable ring of said at least one foldable ring comprising:

a ring portion having a substantially semi-circular shape, said ring portion having a first end and a second end, said ring portion having a predetermined thickness, said ring portion having a predetermined width; and means for selectively folding said ring portion; and foldable ring connection means for selectively connecting said ring portion to each of said first and second side members;

wherein said first and second members are foldable along said centerline between a closed orientation and an open orientation, further wherein said at least one foldable ring selectively folds between an unfolded configuration when said first and second members are at said open orientation to a folded configuration when said first and second members are at said closed orientation;

whereby the pages are held with respect to the binder-folder by said at least one foldable ring threading respectively through the at least one hole of the pages.

2. The binder-folder of claim 1, wherein said at least one foldable ring comprises at least two foldable rings each mutually separated a predetermined distance along said centerline.

3. The binder-folder of claim 1, wherein said ring portion has an apex, further wherein said means for selectively folding said ring portion provides an apex fold at said apex, a first basal fold adjacent said first end of said ring portion and a second basal fold adjacent said second end of said ring portion, and wherein said selective folding of said foldable ring substantially occurs at said apex fold, said first basal fold and said second basal fold.

4. The binder-folder of claim 3, wherein said at least one foldable ring comprises at least two foldable rings each mutually separated a predetermined distance along said centerline.

5. The binder-folder of claim 3, wherein said at least one foldable ring comprises foot means connected with at least one of said first end of said ring portion and said second end of said ring portion for providing connecting structure of said foldable ring with respect to at least one of said first and second side members; wherein said foldable ring connection means provides a selectively releasable connection of said foot means with respect to at least one of said first and second side members.

6. The binder-folder of claim 5, wherein said at least one foldable ring comprises at least two foldable rings each mutually separated a predetermined distance along said centerline.

7. The binder-folder of claim 3, wherein said first and second basal folds are oriented at an angle of substantially between ninety and forty-five degrees with respect to said centerline, wherein said first and second basal folds have an imaginary intersection facing in a direction toward that of folding of said apex fold.

8. The binder-folder of claim 7, wherein said angle is substantially between seventy-five and sixty degrees with respect to said centerline.

9. The binder-folder of claim 8, wherein said at least one foldable ring comprises at least two foldable rings each mutually separated a predetermined distance along said centerline.

10. The kinder-folder of claim 9, wherein said at least one foldable ring comprises foot means connected with at least one of said first end of said ring portion and said second end of said ring portion for providing connecting structure of said foldable ring with respect to at least one of said first and second side members; wherein said foldable ring connection means provides a selectively releasable connection of said foot means with respect to at least one of said first and second side members.

11. The binder-folder of claim 1, wherein said foldable ring is an openable foldable ring, said ring portion comprising:

a first ring section having said first end and a third end;

a second ring section having said second end and a fourth end; and hinged connector means for providing a selectively openable and closeable connection of said third end with respect to said fourth end so as to provide said ring portion.

12. The binder-folder of claim 11, wherein said ring portion has an apex, further wherein said means for selectively folding said ring portion provides an apex fold at said apex, a first basal fold adjacent said first end of said ring portion and a second basal fold adjacent said second end of said ring portion, and wherein said selective folding of said foldable ring substantially occurs at said apex fold, said first basal fold and said second basal fold; further wherein said hinged connector means is located at said apex of said foldable ring.

13. The binder folder of claim 12, wherein said hinged connector means comprises:

a female connector connected with said fourth end of said second ring section, said female connector having a post and an adjoining notch; and a male connector connected with said third end of said first ring section, said male connector having a clasp, said clasp being provided with a slot;

wherein said clasp engages and disengages snappingly with respect to said post by said post passing through said slot; and wherein said apex fold is provided by said clasp rotatively moving with respect to said post.

14. The binder-folder of claim 13, wherein said first and second basal folds are oriented at an angle of substantially between ninety and forty-five degrees with respect to said centerline, wherein said first and second basal folds have an imaginary intersection facing in a direction toward that of folding of said apex fold.

15. The binder-folder of claim 14, wherein said angle is substantially between seventy-five and sixty degrees with respect to said centerline.

16. The binder-folder of claim 14, wherein said at least one foldable ring comprises at least two foldable rings each mutually separated a predetermined distance along said centerline.

17. A kit for converting a folder into a binder-folder, wherein the folder has a first side member and a second side member, the first and second side members mutually folding with respect to each other, a centerline being located between the first and second side members of the folder, said kit comprising:

a blank constructed of a thin, durable sheet material, said blank comprising:

a first base member;

a second base member, a base centerline being located between said first base member and said second base member;

at least one foldable ring selectively connected with at least one of said first and second base members, said at least one foldable ring comprising:

a ring portion having a substantially semi-circular shape, said ring portion having a first end and a second end, said ring portion having a predetermined thickness, said ring portion having a predetermined width;

means for at least in part separating said at least one foldable ring from said at least one of said first and second base members; and means for selectively folding said ring portion;

connection means for selectively connecting said at least one foldable ring to said first and second base members after said at least one foldable ring has been at least in part separated from said at least one of said first and second base members; and attachment means for attaching said first base member to the first side member of the folder and for attaching said second base member to the second side member of the folder so that said base centerline at least substantially coincides with the centerline between the first and second side members of the folder.

18. The kit of claim 17, wherein said at least one foldable ring has foot means connected with at least one of said first end of said ring portion and said second end of said ring portion for providing connecting structure of said foldable ring with respect to at least one of said first and second base members; further wherein said foldable ring connection means provides a selectively releasable connection of said foot means with respect to at least one of said first and second side members.

19. The kit of claim 18, wherein said ring portion has an apex, further wherein said means for selectively folding said ring portion provides an apex fold at said apex, a first basal fold adjacent said first end of said ring portion and a second basal fold adjacent said second end of said ring portion, and wherein said selective folding of said foldable ring substantially occurs at said apex fold, said first basal fold and said second basal fold.

20. The kit of claim 19, wherein said first and second basal folds are oriented at an angle of substantially between ninety and forty-five degrees with respect to the centerline, wherein said first and second basal folds have an imaginary intersection facing in a direction toward that of folding of said apex fold.

21. The kit of claim 20, wherein said angle is substantially between seventy-five and sixty degrees with respect to said centerline.

22. The kit of claim 21, wherein said at least one foldable ring comprises at least two foldable rings.

23. The kit of claim 22, wherein said first and second base members are mutually separated along said base centerline; wherein said first and second base members are interconnected by said at least two foldable rings prior to said at least two foldable rings being at least in part separated therefrom.

* * * * *